US005646666A

United States Patent [19]

Cowger et al.

[11] Patent Number: 5,646,666

[45] Date of Patent: Jul. 8, 1997

[54] BACK PRESSURE CONTROL IN INK-JET PRINTING

[75] Inventors: Bruce Cowger; Robert R. Beeson, both of Corvallis, Oreg.; Christopher A. Schantz, Foster City; William J. West, Los Altos, both of Calif.

[73] Assignee: Hewlett-Packard Company, Palo Alto, Calif.

[21] Appl. No.: 187,367

[22] Filed: Jan. 26, 1994

Related U.S. Application Data

[63] Continuation of Ser. No. 873,918, Apr. 24, 1992, abandoned.

[51] Int. Cl.[6] ..... B41J 2/175

[52] U.S. Cl. ..... 347/87; 347/88

[58] Field of Search ..... 347/84, 85, 87, 347/88, 14, 17, 99, 54, 67, 43, 29, 30

[56] References Cited

U.S. PATENT DOCUMENTS

| | | | |
|---|---|---|---|
| 3,296,624 | 1/1967 | Ascoli | 346/140 |
| 3,434,471 | 3/1969 | Liston . | |
| 3,438,058 | 4/1969 | Davis | 346/140 |
| 3,452,361 | 6/1969 | Williams, Jr. | 346/140 |
| 3,560,641 | 2/1971 | Taylor et al. | 178/6.6 |
| 3,871,004 | 3/1975 | Rittberg | 346/75 |
| 3,946,398 | 3/1976 | Kyser et al. | 346/1.1 |
| 4,054,883 | 10/1977 | Ozone | 346/140 R |
| 4,121,222 | 10/1978 | Diebold et al. | 346/75 |
| 4,149,172 | 4/1979 | Heinzl et al. | 346/140 R |
| 4,217,058 | 8/1980 | Straszewski et al. | 401/135 |
| 4,234,885 | 11/1980 | Arway | 346/140 R |
| 4,238,804 | 12/1980 | Warren | 346/75 |
| 4,263,602 | 4/1981 | Matsumoto et al. | 346/449 |
| 4,272,733 | 6/1981 | Halasz | 346/140 R |
| 4,318,114 | 3/1982 | Huliba | 346/140 JJ |
| 4,325,072 | 4/1982 | Rösel | 346/140 R |
| 4,342,042 | 7/1982 | Cruz-Uribe et al. | 346/140 R |
| 4,382,707 | 5/1983 | Anderka | 401/198 |
| 4,412,232 | 10/1983 | Weber et al. | 346/140 R |
| 4,422,084 | 12/1983 | Saito | 346/140 R |
| 4,492,969 | 1/1985 | Terasawa | 346/140 R |
| 4,494,124 | 1/1985 | Piatt et al. | 346/1.1 |
| 4,500,895 | 2/1985 | Buck et al. | 346/140 R |
| 4,502,054 | 2/1985 | Brescia et al. | 346/75 |
| 4,503,443 | 3/1985 | Dagna et al. | 346/140 R |
| 4,509,062 | 4/1985 | Low et al. | 346/140 R |
| 4,510,510 | 4/1985 | Terasawa | 346/140 R |
| 4,555,719 | 11/1985 | Arway et al. | 346/140 R |
| 4,580,147 | 4/1986 | DeYoung, et al. | 346/140 R |
| 4,593,296 | 6/1986 | Dagna | 347/43 |
| 4,597,719 | 7/1986 | Tano | 417/317 |
| 4,598,729 | 7/1986 | Naito et al. | 137/907 |
| 4,614,948 | 9/1986 | Katerberg et al. | 346/75 |
| 4,620,202 | 10/1986 | Koto et al. | 346/140 R |
| 4,628,333 | 12/1986 | Terasawa | 347/30 |
| 4,631,554 | 12/1986 | Terasawa | 346/140 R |
| 4,658,274 | 4/1987 | De Young | 347/88 |
| 4,677,447 | 6/1987 | Nielsen | 346/140 R |
| 4,714,937 | 12/1987 | Kaplinsky | 346/140 R |
| 4,777,497 | 10/1988 | Nozu et al. | 346/140 R |
| 4,791,438 | 12/1988 | Hanson et al. | 346/140 R |

(List continued on next page.)

FOREIGN PATENT DOCUMENTS

| | | | |
|---|---|---|---|
| 0138322/A1 | 8/1984 | European Pat. Off. . | |
| 0429434/A2 | 9/1987 | European Pat. Off. . | |
| 0336043/A3 | 11/1988 | European Pat. Off. . | |
| 0493978/A1 | 12/1991 | European Pat. Off. . | |
| 56-92072 | 7/1981 | Japan | 346/140 |
| 156262 | 9/1982 | Japan | 347/85 |
| 143967 | 7/1985 | Japan | 347/30 |
| 145039 | 6/1988 | Japan | 347/85 |
| 0236559 | 10/1988 | Japan . | |
| 295268 | 12/1988 | Japan | 347/30 |
| 0012917 | 1/1991 | Japan . | |
| 2063175 | 6/1981 | United Kingdom . | |

*Primary Examiner*—N. Le

[57] ABSTRACT

The system for controlling the back pressure in the reservoir of an ink-jet pen includes a pump for removing air from the reservoir and a vacuum regulator to ensure that the back pressure within the reservoir does not exceed a level that would cause the print head to fail.

10 Claims, 1 Drawing Sheet

U.S. PATENT DOCUMENTS 4,811,035 3/1989 Huliba et al. ..... 346/75
4,814,786 3/1989 Hoisington et al. ..... 346/140 R
4,920,362 4/1990 Cowger ..... 346/140 R
4,992,802 2/1991 Dion et al. ..... 346/1.1
4,994,824 2/1991 Winslow ..... 346/140 R
5,039,999 8/1991 Winslow et al. ..... 347/85
5,040,002 8/1991 Pollack et al. ..... 347/87

BACK PRESSURE CONTROL IN INK-JET PRINTING

This is a continuation of application Ser. No. 07/873,918 filed on Apr. 24, 1992, now abandoned.

TECHNICAL FIELD

The present invention is directed to a system for controlling the fluid pressure in the reservoirs of ink-jet printers and that may be used with printers that use solid or liquid inks.

BACKGROUND INFORMATION

One type of ink-jet printer employs ink that is solid under ambient conditions and heated to a liquid state during the printing operation. The solid ink is stored in a reservoir that has a print head mounted to it. The print head includes a firing chamber through which the liquified ink is directed for ejection through adjacent orifices in the print head. The mechanism for ejecting the liquified ink may employ, for example, a piezoelectric element that is responsive to a control signal for abruptly compressing a volume of the liquified ink in the firing chamber thereby to produce a pressure wave that forces the ink drops through the print head orifices.

Typically, solid inks must be heated to approximately 130° C. to reach the liquified state for printing. The resultant temperature increase in the reservoir leads to significant expansion of the volume of air in the reservoir. Further, solid inks normally include volatile jetting agents that contribute to a substantial increase in vapor pressure within the reservoir as the ink is melted. If the fluid pressure increase attributable to the air expansion and vapor pressure increase were permitted to build within the reservoir, the liquified ink would be uncontrollably forced by the high reservoir pressure through the print head. The problem of liquid ink moving in such a way through the print head is known as drooling.

Irrespective of whether there is a substantial increase in fluid pressure within the reservoir, it is typically desirable to establish a slight back pressure within the reservoir so that the liquified ink will remain in the reservoir until deliberately expelled by the activated print head. As used herein, the term "back pressure" means the partial vacuum within the reservoir for resisting the flow of liquified ink through the print head. Back pressure is considered in the positive sense so that an increase in back pressure represents an increase in the partial vacuum. Accordingly, the back pressure is measured in positive terms, such as water column height.

The back pressure in the reservoir must not be so strong, however, that the print head is unable to overcome the back pressure to eject ink.

Ink-jet printers that employ liquid inks often use a thermal-type ink ejection mechanism that includes resistors that are selectively heated for vaporizing portions of ink near adjacent orifices. The rapid expansion of the ink vapor forces drops of ink through the orifices.

Liquid-ink type printers are susceptible to the drooling problem mentioned above and, therefore, require the establishment of a controlled level of the back pressure within the reservoir. The back pressure level must be regulated to account for changes in the fluid pressure within the reservoir, such fluid pressure changes being attributable, for example, to changes in ambient temperature or pressure.

SUMMARY OF THE INVENTION

The present invention is directed to a mechanism for controlling the back pressure in an ink-jet printer that prints normally liquid ink or liquified ink that is normally stored in a solid state within a reservoir. In a preferred embodiment, the back pressure within the reservoir is controlled by a pump that is connected to the reservoir and activated by the printing apparatus to pump air from the reservoir, thereby to maintain a back pressure within the reservoir despite the fluid pressure increase that occurs as solid ink is melted. Also included is a regulator that is connected to the reservoir and operable for limiting the magnitude of the back pressure maintained by the pump so that the back pressure remains below a level that would otherwise cause the print head to fail.

DESCRIPTION OF A PREFERRED EMBODIMENT

Figure 1:
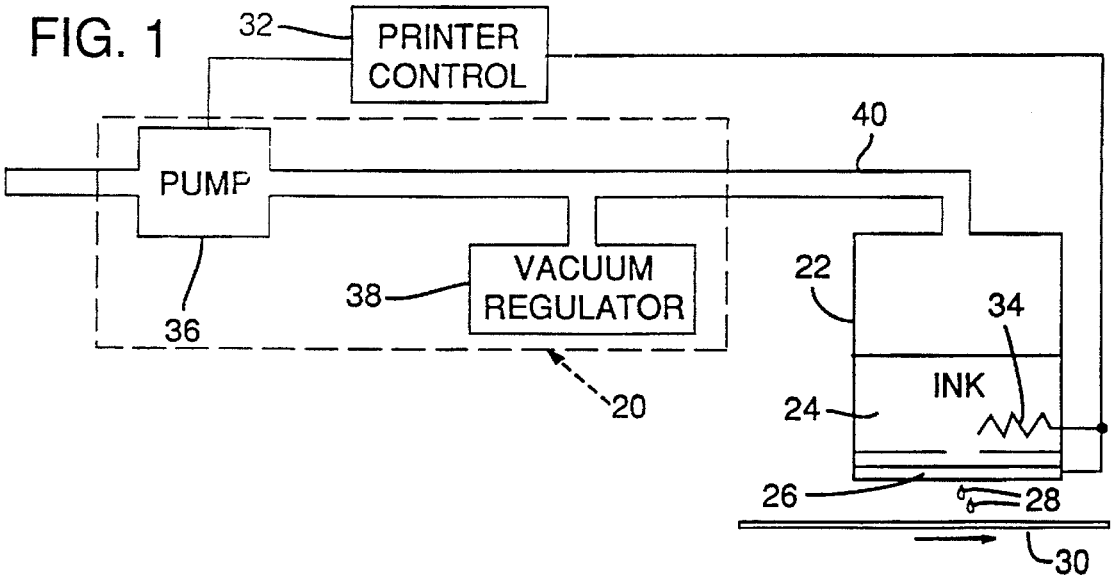
FIG. 1 is a block diagram of a system for controlling back pressure in an ink-jet printing apparatus.

With reference to FIG. 1, the system 20 of the present invention is connected to a reservoir 22 that contains ink 24 that is in a solid state at room temperature. A print head 26 is mounted to the reservoir 22 and is operable by mechanisms known in the art, such as piezoelectric elements, for ejecting ink drops 28 onto paper 30 that is moved relative to the print head.

It is noteworthy that, although the following descriptive material generally relates to a solid-ink type printer, the system of the present invention is also useful with liquid-ink printers that use thermal-type print heads.

The piezoelectric elements of the print head 26 may be selectively activated by a conventional printer control system 32 at a sequence for ejecting the drops 28 to produce on the paper an image or text.

When the printer is activated, a heater 34 is operated to liquify the stored ink 24. In a preferred embodiment, the ink reaches the liquid state (hence, ready for printing) at about 130° C.

As a consequence of heating the ink, the fluid pressure within the reservoir 22 increases. The system 20 of the present invention is employed for adjusting the pressure within the reservoir during the time the ink is in the liquid state so as to establish within the reservoir a back pressure at a level suitable for preventing ink from drooling from the print head. Moreover, the back pressure is regulated so that it does not exceed a level that would cause the print head to fail as a result of being unable to overcome the back pressure, which could lead to air being drawn into the reservoir through the print head.

Figure 2:
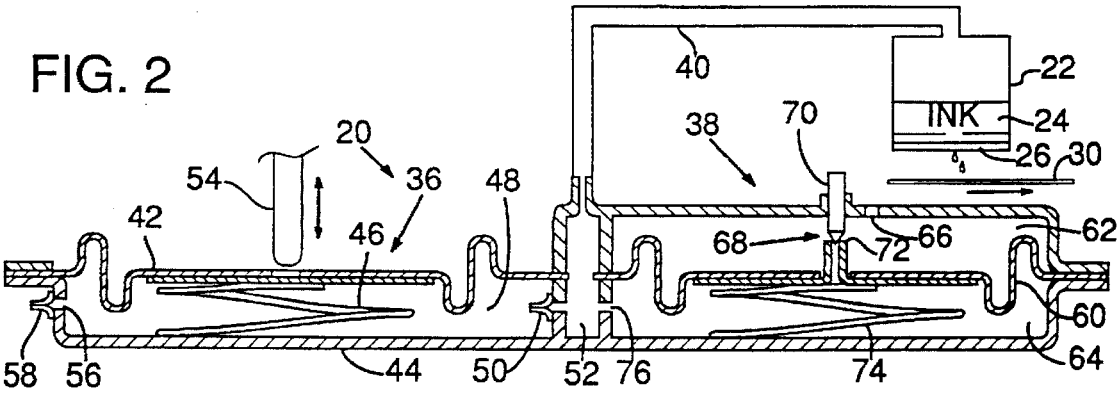
FIG. 2 is a diagram, partly in section, showing a preferred embodiment of a pump and regulator for controlling back pressure in the ink reservoir of the apparatus.

As shown in FIG. 2, the system of the present invention generally comprises a pump 36 and associated vacuum regulator 38, each connected by a conduit 40 to the top of the reservoir 22. The pump may be any positive-displacement pump, such as the depicted diaphragm-type. In a preferred embodiment, the flexible pump diaphragm 42 is mounted to a pump body 44 and supported by a spring 46 in a position to define a pump chamber 48.

A manifold 52 is also defined by the pump body 44. The manifold 52 is connected to the pump chamber 48 by a check valve 50. The manifold 52 is also in fluid communication, via conduit 40, with the interior of the reservoir 22. Accordingly, the fluid path between the pump chamber 48 and reservoir interior is defined by the manifold 52 and connected conduit 40.

The pump 36 is mechanically actuated by a reciprocating push rod 54, which, when advanced, compresses the spring 46 and thereby reduces the volume of the pump chamber 48. The increase in pressure within the chamber 48 attributable to the reduced volume causes air within the chamber to be expelled from a port 56 and associated check valve 58.

The expansion of the spring 46 that occurs when the push rod 54 is retracted increases the volume of the pump chamber 48 so that the consequent pressure drop in the chamber produces a sufficient pressure gradient for drawing air from the manifold 52 (hence, from the reservoir 22) into the chamber 48. It will be appreciated by one of ordinary skill that the reciprocating push rod and spring-biased diaphragm provides a pump that, while operating, continuously reduces the pressure in the conduit 40 leading to the reservoir 22.

Preferably, the push rod 54 is connected to a motor (not shown) that is actuated by the printer control 32 whenever the printer is turned on so that the pump will operate whenever the ink is heated.

The pump 36 described above is effective for removing the gas or air within the reservoir 22 and thereby regulating the pressure increase that would otherwise occur, for example, as the ink changes from the solid to the liquid state. The pump 36, therefore establishes a back pressure within the reservoir while the ink is in the liquid state so that the liquid ink will not drool from the print head.

The conduit 40 is readily detachable from the reservoir 22 so that the user can refill the reservoir 22 with ink as necessary. It will be appreciated that the system for establishing back pressure within the reservoir is not affected by refilling of the reservoir.

The regulator 38 is connected to the pump 36 via manifold 52 and operates to deliver ambient air to the manifold (hence, to the conduit 40) so that the back pressure within the reservoir 22 will not be increased by the pump 36 to a level so high that the print head fails. Preferably, the regulator 38 is constructed as an extension of the pump body 44, which body defines a volume that is divided by a diaphragm 60 into an inlet chamber 62 and outlet chamber 64. The inlet chamber 62 of the regulator is in fluid communication with ambient air through a port 66.

A needle valve assembly 68 is part of the regulator 38. The valve assembly 68 includes an adjustable needle 70, which can be advanced or retracted against one end of a valve tube 72 that is mounted to the diaphragm 60 to provide an air conduit between the inlet chamber 62 and outlet chamber 64. A compression spring 74 urges the tube 72 against the needle 70. Advancing or retracting the needle 70 increases or decreases, respectively, the amount of pressure drop within the outlet chamber 64 that is necessary for opening the valve 68 and thereby providing the outlet chamber 64 with ambient air via the valve tube 72 and port 66.

Air in the outlet chamber 64 may pass through a port 76 into the manifold 52, thereby to relieve the back pressure increase in the reservoir that would otherwise occur if the pump 36 were to continue to pump air solely from the reservoir 22.

In a preferred embodiment of the system, the needle valve assembly 68 of the regulator 38 is adjusted so that the valve will open whenever the back pressure within the reservoir 22 (hence, within the outlet chamber 64) increases to about 2 inches water column height. It is understood that adjustment of the needle valve assembly to establish the desired back pressure level will be a function of the diaphragm area, thickness, and elasticity, as well as the spring rate and free length.

When the printer is turned off, the pump 36 is also deactivated and the ink cools and solidifies. As the ink cools its volume decreases. The air in the reservoir cools and contracts, and vapors in the reservoir condense. The consequent increase in the back pressure within the reservoir attributable to the volume reduction of the air and ink is relieved by the regulator 38 to remain under the predetermined (e.g., 2 in. water column height) back pressure level.

Preferably, the system is arranged so that when the printer is in the proper orientation for printing, the diaphragm 60 of the regulator will be in the horizontal orientation as shown in FIG. 2. The partial vacuum pressure within the outlet chamber 64 is, therefore, in part affected by the weight of the diaphragm 60 and connected valve tube 72 because the weight of those components tend to compress the spring 74 and reduce the volume of the outlet chamber 64. Should the printer be tipped or otherwise moved out of the printing position so that the printer and attached pump body 44 are moved toward a vertical orientation, the weight of the regulator diaphragm 60 and attached valve component tube 72 will be removed from the spring 74, resulting in a slight increase in the outlet chamber volume and concurrent increase in the back pressure within the reservoir. Consequently, the back pressure within reservoir 22 will change (increase) slightly whenever the printer is moved out of the printing orientation, thereby to slightly reduce the likelihood of drooling when the printer is not in the printing orientation.

Figure 3:
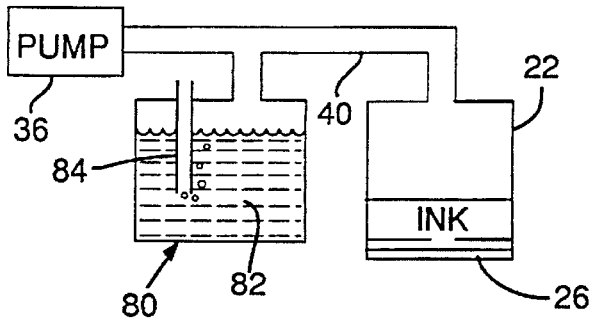
FIG. 3 is a diagram of an alternative regulator that may be used with the system.

Having described and illustrated the principles of the invention with reference to the preferred embodiment, it should be apparent that the invention can be further modified in arrangement and detail without departing from such principles. For example, the conduit 40 can branch to more than a single ink reservoir 22 for controlling the back pressure within those reservoirs. Further, an air weir 80 (FIG. 3) may be substituted for the vacuum regulator 38. The air weir 80 could comprise a chamber filled with liquid, such as water 82 or other liquid with a relatively low vapor pressure to avoid evaporation loss. A tube 84, opening to ambient air at one end, would be mounted to the air weir 80 to extend into the liquid 82 to a depth corresponding to the back pressure (that is, the water column height) that is to be established in the reservoir 22.

It is also contemplated that the means for regulating the level of the back pressure established by the pump could be incorporated as part of the check valve 58 associated with the valve chamber 48, thereby obviating the need for a separate regulator component. In this regard, the check valve could be designed to deliberately leak (that is, permit air back flow into the pump chamber 48) and, particularly, to leak at a relatively high rate when the reservoir back pressure communicated to the valve chamber 48 approaches the desired maximum back pressure to be established within the reservoir. Preferably, the leak rate of the valve would be very low whenever the back pressure is within the preferred range. The slow leak rate would provide a temporary retention of back pressure whenever the pen is inactivated for a brief interval, such as may occur during a power failure. Although the one-way or check valves 50, 58 have been depicted as discrete components, it is contemplated that the valves may be formed integrally with an extension of the diaphragm 42 would cover the ports associated with those valves. It is understood that the present invention includes all such modifications that may come within the scope and spirit of the following claims, and equivalents thereof.

The invention claimed is:

1. A back pressure control system for a reservoir that contains a supply of ink and a volume of working fluid, comprising:

a print head mounted to the reservoir, the print head including means for expelling ink drops from the reservoir;

a pump connected to the reservoir and operable for pumping working fluid from the reservoir, thereby to establish and maintain within the reservoir a back pressure; and a regulator for limiting to a predetermined level the back pressure established by the pump, the regulator including a valve connected to the reservoir to be responsive to changes in back pressure within the reservoir by delivering ambient air to the reservoir, the pump and regulator maintaining the back pressure in the reservoir as ink drops are expelled by the print head.

2. The system of claim 1 wherein the ink is contained in a solid state and wherein the reservoir includes a heater operable for liquefying the ink, the system including control means for activating the pump for pumping working fluid from the reservoir in response to operation of the heater, and wherein the working fluid is air.

3. The system of claim 1 wherein the regulator is a diaphragm-type vacuum regulator.

4. The system of claim 1 wherein the regulator is an air weir.

5. The system of claim 1 wherein the regulator is adjustable to allow for adjustment of the predetermined level of back pressure.

6. The system of claim 1 wherein the reservoir and regulator are mounted to a printing device and wherein the regulator is arranged to assume a first position when the printing device is in an operating position and wherein the predetermined level of the back pressure changes when the regulator is moved out of the first position.

7. The back pressure control system of claim 1 wherein the working fluid is air.

8. The system of claim 1 wherein the regulator comprises a body adapted to form therein an inlet chamber open to ambient and an outlet chamber, the outlet chamber being in fluid communication with the reservoir; and wherein the valve is adjustable to control air flow from the inlet chamber to the outlet chamber thereby to change the limit of the back pressure level.

9. A method of controlling back pressure within an ink reservoir that contains a supply of ink and a volume of air, comprising the steps of:

mounting a print head to the reservoir;

expelling ink drops from the print head;

pumping air from the reservoir thereby to establish and maintain a partial vacuum within the reservoir during the time that ink drops are expelled from the print head, wherein the expelling of ink drops from the print head and the pumping of air from the reservoir cause changes in reservoir back pressure; and selectively connecting the reservoir to ambient air in response to changes in reservoir back pressure thereby to limit the level of the back pressure within the reservoir.

10. The method of claim 9 including the step of melting the ink.

* * * * *